US005174740A

United States Patent [19]

Jang

[11] Patent Number: 5,174,740

[45] Date of Patent: Dec. 29, 1992

[54] HERMETIC TYPE SCROLL COMPRESSOR WITH REGULATION OF LUBRICANT TO THE INLET

[75] Inventor: Sung-Pil Jang, Seoul, Rep. of Korea

[73] Assignee: Samsung Electronics Co., Ltd., Kyungki, Rep. of Korea

[21] Appl. No.: 738,432

[22] Filed: Jul. 31, 1991

[30] Foreign Application Priority Data

Jul. 31, 1990 [KR] Rep. of Korea ..... 90-11754

[51] Int. Cl.[5] ..... F04C 18/04; F04C 29/02

[52] U.S. Cl. ..... 418/55.6; 418/84; 418/87; 418/100

[58] Field of Search ..... 418/55.6, 84, 87, 100

[56] References Cited

U.S. PATENT DOCUMENTS 3,243,103 3/1966 Bellmer ..... 418/100
3,671,148 6/1972 Reeve ..... 418/100
4,568,256 2/1986 Blain ..... 418/94

FOREIGN PATENT DOCUMENTS 56-20793 2/1981 Japan ..... 418/55.6
1-290990 11/1989 Japan ..... 418/55.6

*Primary Examiner*—John J. Vrablik
*Attorney, Agent, or Firm*—Burns, Doane, Swecker & Mathis

[57] ABSTRACT

A scroll compressor includes a stationary scroll and an orbit scroll for circulating refrigerant. Lubricant is introduced into the refrigerant at an inlet side of the compressor to maintain a seal between the scrolls. Lubricant is separated from the refrigerant within a discharge chamber. A control mechanism varies the flow of lubricant into the refrigerant as a function of a pressure occurring at an outlet side of the scrolls, and also as a function of the amount of lubricant present in the discharge chamber.

5 Claims, 3 Drawing Sheets

HERMETIC TYPE SCROLL COMPRESSOR WITH REGULATION OF LUBRICANT TO THE INLET

FIELD OF THE INVENTION

This invention relates to a hermatic type scroll compressor for an air conditioner which compresses a refrigerant by a fixed scroll and an orbiting scroll.

BACKGROUND ART

A typical scroll compressor of this kind is disclosed, for instance, in U.S. Pat. No. 4,568,256 of Edward S. Blain. The scroll compressor disclosed in said publication relates to a compressor for separating a lubricant from refrigerant by comprising: first and second scrolls having interfitting vanes defining a pumping interface including a movable fluid-containing pocket; means for moving one of said scrolls in a closed, non-linear path relative to the other to cause said pocket to move along said interface; a plurality of radially inner outlets partially in at least one of said scrolls and opening to said interface; a radially outer inlet opening to said interface; an open conduit within said one scroll extending from said outlet to said interface remote from said outlet; and means associated with said outlet for inducing rotary motion in a fluid therein to cause centrifugal separation of lubricant from the fluid in the vicinity of said conduit.

On the other hand, another conventional hermetic type scroll compressor is shown in cross section in FIG. 3. As shown in FIG. 3, it is constructed of a hermetic container defined by a cylindrical body 1, a bottom plate 2, and a top cover 3. Fixed and orbiting scrolls 26, 24 are disposed within the container. In order to smoothly feed a cooling lubricant for maintaining a fluid tightness, i.e., seal between the fixed scroll 26 and the orbiting scroll 24, a lubricant feeding capillary tube 11 is provided adjacent a suction pipe 19, and the lubricant contained within refrigerant gas discharged from discharging outlet 27 is drained to the lower part of the container through a capillary tube 15.

There occurs an improved fluid tightness of the fixed scroll 26 and the orbiting scroll 24, when cooling lubricant is fed. However, there has been a problem that although discharging pressure is increased according to the improvement of said fluid tightness, because a pressure difference with suction pipe 19 becomes increased, the cooling lubricant is excessively fed through the lubricant feeding capillary tube 11.

OBJECT AND SUMMARY OF A PREFERRED EMBODIMENT OF THE INVENTION

The present invention is made for solving such aformentioned problem, and it is an object of the present invention to provide a hermetic type scroll compressor capable of automatically controlling the amount of feeding the lubricant in accordance with an increase in discharging pressure caused by the improvement of fluid tightness (sealing) between the fixed scroll and the orbiting scroll as well as in accordance with the amount of lubricant contained within refrigerant gas discharged out of a discharging port.

In order to accomplish the above-described object, the hermetic type scroll compressor of the present invention is, comprised of a hermetic container, a frame in which an upper part and a lower part of the hermetic container are partitioned to form a discharging chamber and a driving chamber. A driving shaft is supported in the container, and fixed and orbiting scrolls are contained within the discharging chamber of the hermetic container. A lubricant feeding control device is provided for controlling the feeding of lubricant into a fluid being compressed in order to maintain the fluid tightness between the fixed scroll and orbiting scroll in the hermetic container. The lubricant feed is controlled in response to the lubricant quantity and discharging pressure discharged out of a discharging port formed at upper surface at adjacent of central portion of the fixed scroll.

DETAILED DESCRIPTION OF THE PREFERRED EMBODIMENT

Hereinafter, a preferred embodiment of the present invention will be described in detail with reference to the accompanying drawings.

Figure 1:
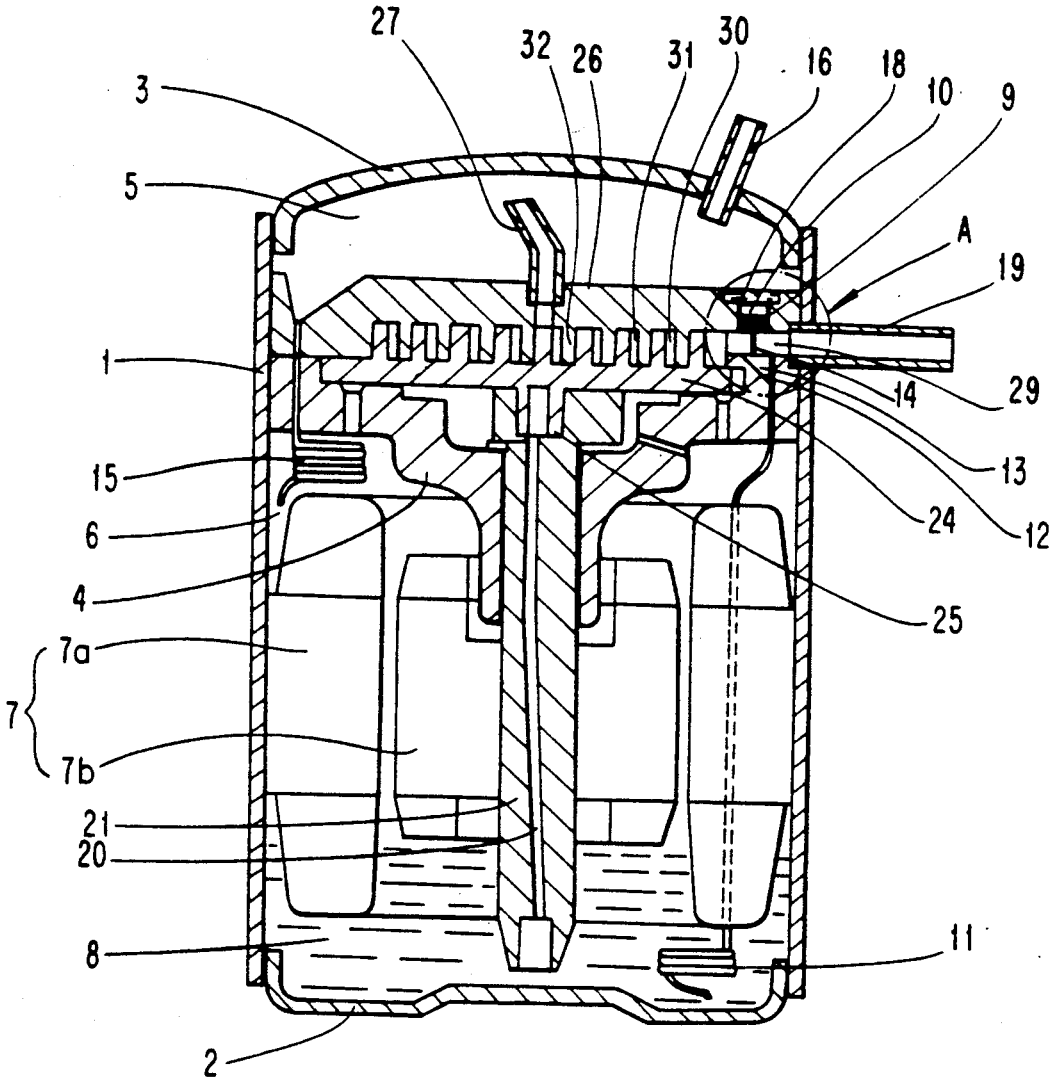
FIG. 1 is a schematic longitudinal cross sectional view of a hermetic type scroll compressor equipped with a lubricant feeding device in a preferred embodiment of the present invention.
Figure 2:
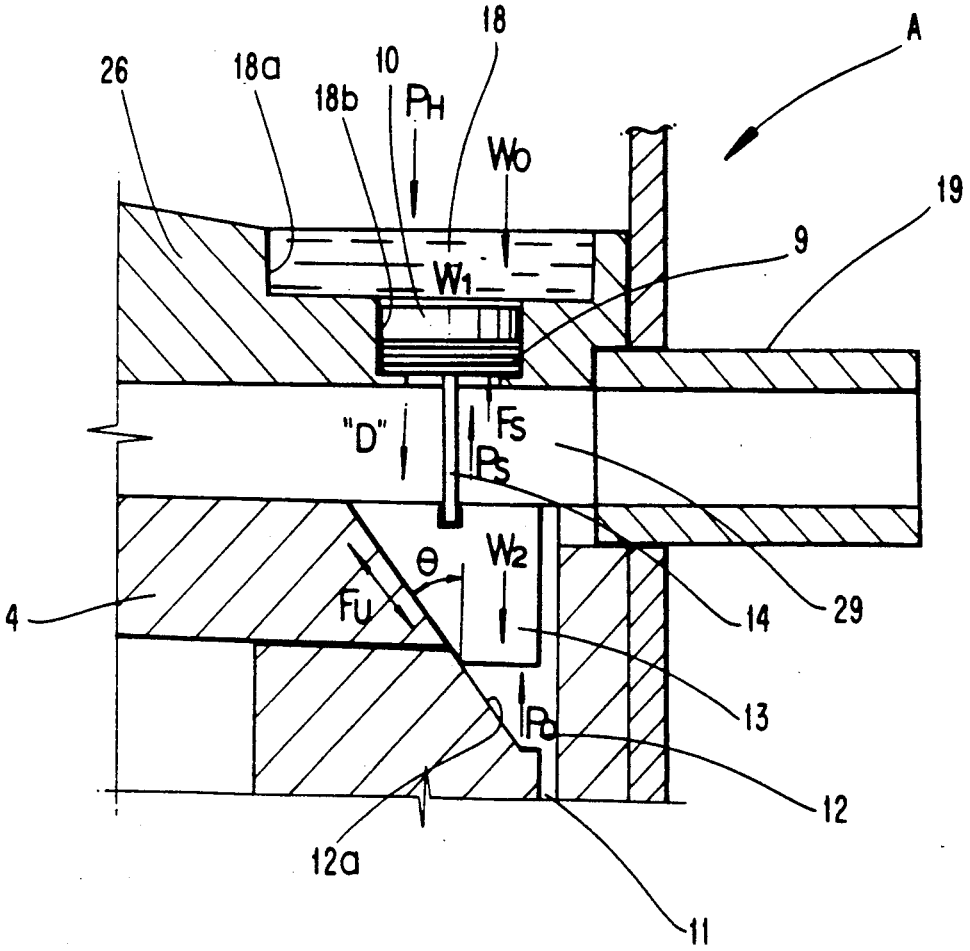
FIG. 2 is a fragmentary magnified cross sectional view of portion A (lubricant feeding control device) of FIG. 1.
Figure 3:
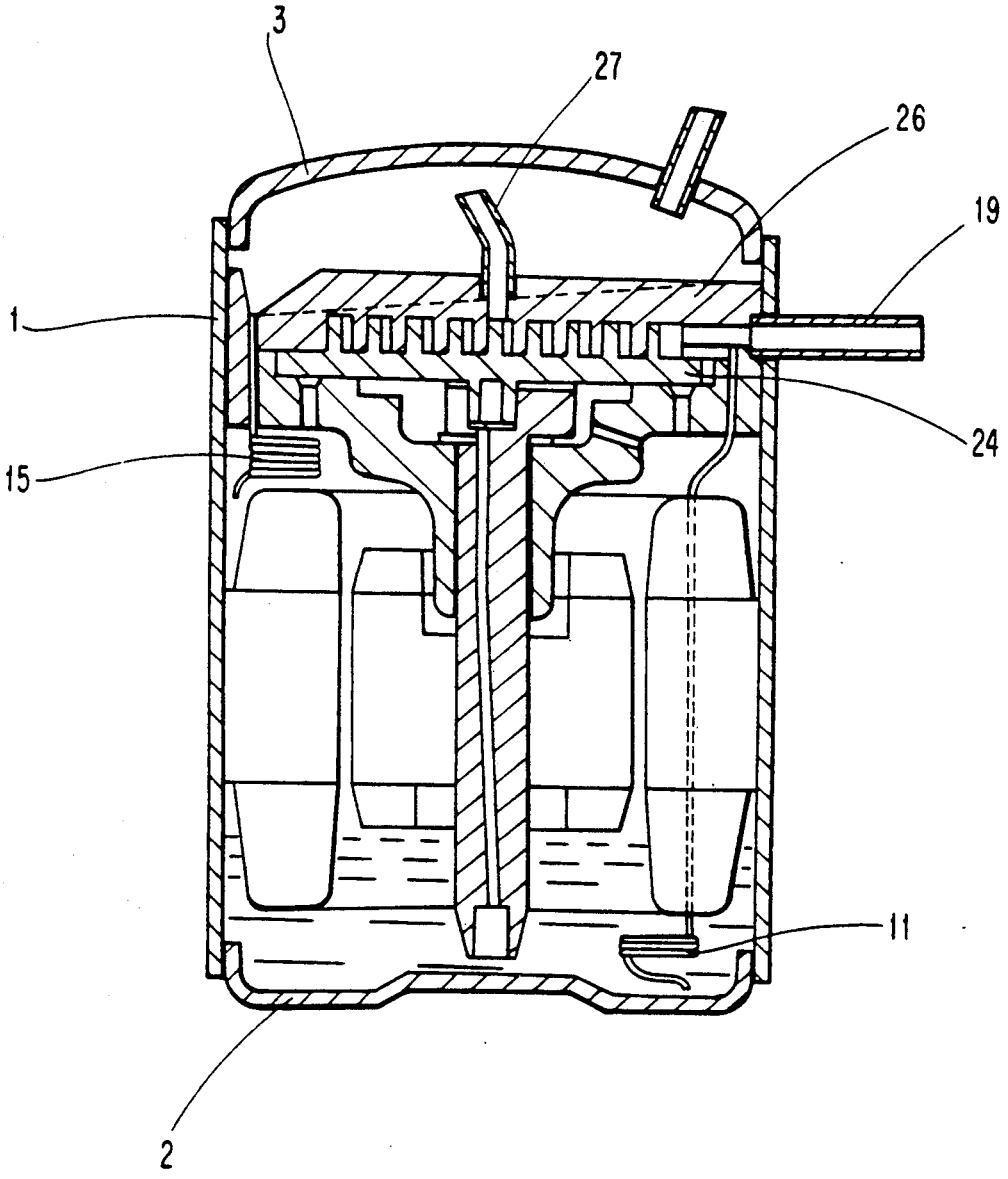
FIG. 3 (PRIOR ART)
FIG. 3 is a schematic longitudinal cross sectional view of a conventional hermetic type scroll compressor.

As shown in FIGS. 1 and 2, a main body of the scroll compressor is comprised of: a cylindrical body 1, a bottom plate 2 rigidly fixed by welding or the like so as to seal a bottom opening of said cylindrical body 1, and a top cover 3 which is rigidly fixed by welding or the like so as to seal a top opening of said cylindrical body 1. Within the cover 3 a discharging pipe 16 is mounted. The interior of the main body is partitioned into two parts by an iron frame 4, namely, a discharging chamber 5 of high pressure formed above the frame 4 and a driving chamber 6 of low pressure formed below the frame 4. A motor 7 consisting of a stator 7*a* and a rotor 7*b* is mounted within said driving chamber 6, and lubricant 8 is reserved in a bottom portion under the motor 7.

A rotary shaft 25 of an orbiting scroll 24 is inserted within an eccentric hollow formed at an upper portion of a driving shaft 21 which is rotated by the motor 7 which is supported by the frame 4 and energized by electric power. A fixed scroll 26 engaging with the orbiting scroll 24 is fixed by a bolt which is not shown. Further, a thin and elongate lubricant feeding hole 20 for communicating the eccentric hollow formed at the upper portion of the driving shaft 21 with the driving chamber 6 is formed in the shaft 21. And, a suction pipe 19 in which high pressure refrigerant discharged through the discharging pipe 16 is returned by way of an exterior cooling cycle piping system, is mounted at a side of the cylindrical body 1 (upper right side in FIG. 1). A low pressure suction chamber 29 is formed between the fixed scroll 26 and the orbiting scroll 24 at an inner side of the suction pipe, and a discharging port 27 for discharging high pressure refrigerant is formed adjacent a central portion of the top surface of the fixed scroll 26. The suction chamber 29 sucks lubricant from the chamber 6 through a first capillary tube 11. The lubricant mixes with the refrigerant and is discharged therewith into the chamber 5. The top surface of the fixed scroll 26 is formed to become gradually lower from the central portion to one side of its circumferential edge such that the lubricant within the discharging chamber 5 is naturally collected, and a chamber 18 for reserving the lubricant is formed around the circumferential edge. At an upper portion of said lubricant reserving chamber 18 there is formed a lubricant reserving portion 18*a* being of a given diameter and a first receiving portion 18*b* of smaller diameter. A pressure valve 10 for controlling the feeding of lubricant is mounted by means of a coil spring 9 adjacent a central portion of said lubricant reserving portion 18*a*. At this first receiving portion 18*b* there is arranged a lubricant feeding control device A which will be described hereinafter. Second capillary tube 15 for conducting the reserved lubricant from the discharge chamber 5 to the driving chamber 6 is formed at an opposite side of the lubricant reserving chamber 18. A second receiving portion 12 is provided which feeds lubricant to the moving parts of the compressor main body in accordance with the pressure of the discharging chamber 5. Within the interior of the second receiving portion 12 there is slidably provided a control valve 13 connected to the pressure valve 10 by way of a supporting bar 14 to open and close the second receiving portion 12. The second receiving portion 12 is constructed with a slant surface 12*a* formed on one side wall of the frame 4, and a control valve 13 is moved up and downward relative to the slant surface 12*a* in response to the amount (i.e. weight) of lubricant reserved within the lubricant reserving chamber 18 to control the rate at which the lubricant reserved at the bottom of container is fed upwardly through the lubricant feeding capillary tube 11 and second receiving portion 12.

Here, the lubricant feeding control device A is comprised of: a pressure valve 10 slidably mounted in the first receiving portion 18*b* of the lubricant reserving chamber 18 formed at upper portion of the fixed scroll 26, a coil spring 9 for urging the pressure valve upward against the pressure in the discharge chamber 5, control valve 13 having a slant surface at one side so as to be slidably disposed on the second receiving portion 12 formed at an upper portion of frame 4, and a supporting bar 14 of which one end is connected to the pressure valve 10 via the coil spring 9 so as to move said control valve 13 up and donward in response to the pressure in the discharge chamber 5 and another end is connected to the control valve 13. And, pressure valve 10 of the lubricant feeding control device A is held by a protuberance (not shown) which is protruded from an upper end edge of first receiving portion 18*b* so that upward travel of the pressure valve 10 is limited.

The lubricant feeding control operation of the hermetic type scroll compressor according to the present invention constructed as above will be described in detail hereinafter.

When electric power is applied to the motor 7, the driving shaft 21 starts to rotate and the orbiting scroll 24 rotates. At this moment, sucked-in refrigerant gas is sucked from the cooling cycle connected to the main body of the compressor through the suction pipe 19 into the suction chamber 29 formed by the fixed scroll 26 and the orbiting scroll 24, and this sucked-in refrigerant gas is fed to first compressing chamber 30 by the orbiting scroll 24 and the fixed scroll 26. A portion of the sucked-in refrigerant gas fed to said first compressing chamber 30 is highly compressed gradually while passing through second compressing chamber 31 and third compressing chamber 32 according to the rotational movement of the orbiting scroll 24, and it is discharged to the discharge chamber 5 through the discharge port 27 formed at adjacent of control portion of the fixed scroll 26. Here, a portion of lubricant contained within the discharged refrigerant gas discharged into the discharge chamber 5 is separated by a conventional filter (not shown) made of thin metal wire arranged between the fixed scroll 26 and the top cover 3 and it is drained through the second capillary tube 15 to the driving chamber 6 to thereby be joined with the lubricant 8 remained at the bottom. The discharged refrigerant gas along with any residual lubricant is returned to the interior of the compressor by way of the discharge pipe 16 as well as the external cooling cycle piping system and through the suction pipe 19.

Since the pressure valve 10 and check valve 13 of the lubricant feeding control device A are arranged respectively within the first receiving portion 18*b* of the lubricant reserving chamber 18 formed on the fixed scroll 26 and the second receiving portion 12, the pressure valve 10 and the control valve 13 of the lubricant feeding control device A are acted upon by: a pressure differential within the hermetic type scroll compressor, an urging force Fs of the coil spring 9, a weight Wo of the lubricant contained within the lubricant reserving portion 18, and by the weight W2 of the control valve 13.

When a normal lubricant feeding amount of the cooling lubricant is maintained, the downward and upward forces exerted on the pressure valve of the lubricant feeding control device A can be expressed by following general expression (1):

$$FPH + Wo + W1 + W2 < Fs + FPs + FPo + F\cos\theta \quad (1)$$

wherein FPH is the force acting on the top surface of valve 10 as the result of pressure PH in the chamber S; Wo is the weight of coolant in the chamber 18 acting on the valve 10; W1 is the weight of valve 10; W2 is the weight of the valve 13; Fs is the force exerted on valve 10 by the spring 9; FPs is the resultant of forces acting on the valves 10, 13 by suction pressure in the port 29; FPo is a force acting on the valve 13 by pressure in the chamber 12; and F cos $\theta$ is a friction force resisting displacement of the valves 10, 13.

In the general expression (1), in case when the force summation of the left side is equal or smaller than the force summation of the right side, the valve 13 moves upwardly and opens to conduct lubricant which is fed through the lubricant feeding capillary tube 11 and second receiving portion 12 in order to improve the fluid tightness between the fixed scroll 26 and the orbiting scroll 24.

Thus, when the lubricant is fed between the fixed scroll 26 and the orbiting scroll 24, fluid tightness is improved between these two scrolls 26, 24, and discharging pressure PH of the compressed refrigerant gas in the discharge chamber 5 becomes larger. That is, when the amount of the lubricant fed through the lubricant feeding capillary tube 11 and second receiving portion 12 is increased, the weight Wo of the cooling lubricant of the discharge chamber 5 is increased, and the general expression is expressed as follows:

$$PH + Wo + W1 + W2 > Fs + Ps + Po + F\cos\theta \quad (2)$$

Thus, the force summation of the left side becomes larger than the force summation of the right side, and the pressure valve 10 and the control valve 13 of the lubricant feeding control device A are moved downward in the direction of arrow D to thereby close the lubricant feeding capillary tube 11 communicated with the second receiving portion 12 so that the feeding of the lubricant is reduced or cut off. In other words, the quantity of cooling lubricant fed between the fixed scroll 26 and the orbiting scroll 24 is automatically and readily controlled according to the extent that the said control valve 13 moves upward or downward.

As described above, according to the present invention, the lubricant feeding rate can be automatically controlled in response to changes in pressure differential between the inlet and discharge sides of the scroll arrangement occurring as the result of changes in the effectiveness of the seal between the scrolls 24, 26.

I claim:

1. A hermetic scroll compressor for circulating a fluid, comprising:

a hermetic container having an internal frame dividing the interior of said container into upper and lower chambers;

an inlet port and an outlet port formed in said container to communicate with said upper chamber;

a scroll arrangement comprising a fixed scroll and an orbiting scroll disposed in said upper chamber, said scroll arrangement having an inlet side communicating with said inlet port and a discharge side communicating with a discharge portion of said upper chamber disposed above said scroll arrangement, said outlet port communicating with said discharge portion of said chamber;

a drive shaft for moving said orbiting scroll so that said scroll arrangement circulates fluid from said inlet side to said discharge portion;

feeding means for feeding lubricant into the fluid at said inlet side of said scroll arrangement to maintain a seal between said fixed and orbiting scrolls, said feeding means including a conduit communicating with a source of lubricant and with said inlet side; and control means for regulating the flow of lubricant to said inlet side as a function of the magnitude of pressure at said discharge side of said scroll arrangement, said control means including a valve disposed below said inlet side for opening and closing said conduit, a control member operably connected to said valve and slidably movable within a recess formed above said inlet side, said recess being in communication with said discharge side of said scroll arrangement, a yieldable biasing means for biasing said control member upwardly toward a valve opening state, and a connecting rod interconnecting said control member and said valve extending across said inlet side.

2. A hermetic scroll compressor according to claim 1, wherein said recess communicates with said discharge portion of said chamber whereby an upper surface of said control member is acted upon by pressure at said outlet side.

3. A hermetic scroll compressor according to claim 2, wherein said recess includes means for collecting lubricant atop said upper surface of said control member, whereby the weight of at least some of the collected lubricant acts downwardly on said control member.

4. A hermetic scroll compressor according to claim 2, wherein said recess also communicates with said inlet side of said scroll arrangement, whereby a lower surface of said control member is acted upon by pressure at said inlet side.

5. A hermetic scroll compressor according to claim 4, wherein said recess includes means for collecting lubricant atop said upper surface of said control member, whereby the weight of at least some of the collected lubricant acts downwardly on said control member.

* * * * *